US011751667B2

(12) United States Patent
Pontano et al.

(10) Patent No.: US 11,751,667 B2
(45) **Date of Patent: *Sep. 12, 2023**

(54) MESS KIT AND UTENSILS

(71) Applicant: Industrial Revolution, Inc., Tukwila, WA (US)

(72) Inventors: Peter Pontano, Seattle, WA (US); Colin Quinn, Seattle, WA (US)

(73) Assignee: Industrial Revolution, Inc., Tukwila, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/167,566

(22) Filed: Feb. 10, 2023

(65) Prior Publication Data

US 2023/0189969 A1 Jun. 22, 2023

Related U.S. Application Data

(63) Continuation of application No. 17/733,087, filed on Apr. 29, 2022, which is a continuation of application No. 16/520,339, filed on Jul. 23, 2019, now Pat. No. 11,344,105.

(60) Provisional application No. 62/702,332, filed on Jul. 23, 2018.

(51) Int. Cl.
*A47G 21/14* (2006.01)
*A45F 3/16* (2006.01)

(52) U.S. Cl.
CPC ..... *A45F 3/16* (2013.01); *A47G 21/14* (2013.01)

(58) Field of Classification Search
CPC ..... A45F 3/16; A47G 21/14; B65D 43/22; B65D 43/162; B65D 45/00
USPC ..... 206/541, 807; 220/315
See application file for complete search history.

(56) References Cited

U.S. PATENT DOCUMENTS

| | | | | |
|---|---|---|---|---|
| 3,746,206 | A | 7/1973 | Utz | |
| 5,845,403 | A | 12/1998 | Nivin | |
| 8,371,468 | B2 * | 2/2013 | Sellari | B65D 55/024 220/4.23 |
| D722,837 | S | 2/2015 | Miksovsky et al. | |
| D753,447 | S | 4/2016 | Busboom | |
| 9,332,867 | B2 * | 5/2016 | Chase | A47G 21/02 |
| 10,384,843 | B2 * | 8/2019 | Vovan | B65D 65/466 |
| 10,543,967 | B2 * | 1/2020 | Guirguis | B65D 55/024 |

(Continued)

OTHER PUBLICATIONS

Screenshot from Industrial Revolution website, www.industrialrev.com, via Archive.org, dated Mar. 25, 2017 (1 page).

(Continued)

*Primary Examiner* — Steven A. Reynolds
(74) *Attorney, Agent, or Firm* — Seed IP Law Group LLP

(57) ABSTRACT

In some embodiments, a mess kit includes a container assembly having a lid portion and a container, each of the lid portion and container including handle portions having apertures that align when the lid portion is connected to the container. In some embodiments, a tether device is provided to connect the lid portion to the container, as well as to releasably connect one or more utensil devices, or utensil assemblies to the container assembly. Also, the utensil assembly can include a first utensil and second utensil connectable together in a first mode, and second mode, with each mode of connection involving inserting a portion of the first utensil into a sheath member of the second utensil.

20 Claims, 11 Drawing Sheets

(56) References Cited

U.S. PATENT DOCUMENTS

| | | | | |
|---|---|---|---|---|
| 2002/0050495 | A1 | 5/2002 | Falcaro | |
| 2009/0206082 | A1* | 8/2009 | Vovan | B65D 43/0249 29/428 |
| 2011/0232102 | A1 | 9/2011 | Holmes | |
| 2012/0152944 | A1* | 6/2012 | Vilkomirski | B25H 3/022 220/849 |
| 2012/0292322 | A1 | 11/2012 | Meyer et al. | |

OTHER PUBLICATIONS

Screenshot from Industrial Revolution website, www.industrialrev.com, via Archive.org, dated Sep. 2, 2017 (1 page).

* cited by examiner

MESS KIT AND UTENSILS

CROSS-REFERENCE TO RELATED APPLICATION(S)

This application is a continuation of U.S. application Ser. No. 17/733,087, filed Apr. 29, 2022, which is a continuation of U.S. application Ser. No. 16/520,339, filed Jul. 23, 2019, now U.S. Pat. No. 11,344,105, which claims the benefit of U.S. Provisional Patent Application No. 62/702,332, filed Jul. 23, 2018, all of which are incorporated herein by reference in their entirety.

BACKGROUND

Technical Field

The present disclosure relates to food container assemblies and utensils, which may be suitable for indoor or outdoor dining, and food transport.

Description of Related Art

Portable food containers and specialized eating utensils are popular for use in connection with outdoor activities, such as camping. Such activities often require the transport of a variety of equipment, including, for example, tents, sleeping gear, utensils, cooking equipment, etc., and as such, consumers of such equipment seek optimal combinations of convenience, compactness and flexibility. There continues to be an unfulfilled need in art for a more optimized portable food container assemblies and versatile eating utensils suitable for outdoor use.

BRIEF SUMMARY

In some embodiments, a mess kit comprises a container assembly having a bowl portion, and a lid portion releasably attachable to the bowl portion. At least a first handle portion is formed on the bowl portion having a first aperture formed therethrough, and at least a second handle portion is formed on the lid portion, having a second aperture formed therethrough. When the lid portion is releasably attached to the bowl portion in alignment therewith, the first aperture is aligned with the second aperture, and the first handle portion is offset from the second handle portion.

The mess kit can include a utensil member attached to the container assembly by a flexible resilient tether. The utensil member includes at least one utensil aperture formed through a surface of the utensil member, and the tether can be extended through the utensil aperture and through at least the first aperture or second aperture of the container assembly for attaching the utensil member to the container assembly.

The utensil member can be an assembly comprising at least a first utensil component and a second utensil component, with the first and second utensil components being separable and releasably connectable to one another. The first utensil component can include a knife member and the second utensil component can include a sheath member having an opening through which the knife member can be inserted when connecting the first utensil component to the second utensil component. Moreover, the first utensil component is releasably attachable to the second utensil component in a first assembly mode such that a convex surface portion of at least the first or second utensil components rests against or proximate a concave surface of at least the first or second utensil components. In the first assembly mode, the first utensil component and second utensil component can be releasably connected together. Moreover, the first utensil component can be releasably attached to the second utensil component in a second assembly mode, wherein the knife member is inserted into the sheath member at a back end portion of the second utensil component such that the first utensil component extends away from the second utensil component, in an extended fashion.

In some embodiments, a utensil assembly comprises a first component having knife portion, a second component having a sheath portion, the knife portion being receivable within the sheath portion in a first assembly mode, and a second assembly mode. In the second assembly mode, an end portion of the knife portion is inserted into the sheath portion at a back end of the second component to be releasably attached thereto, and the first component extends backward from the second component, and wherein in the first assembly mode, the knife portion is inserted into the sheath component on a front end of the sheath component and the first component extends forward of the front of the sheath portion, overlapping the second component in a nesting position.

DETAILED DESCRIPTION

In the present disclosure, certain specific details are set forth in order to provide a thorough understanding of various embodiments of the disclosure. However, upon reviewing this disclosure one skilled in the art will understand that the various embodiments disclosed herein may be practiced without many of these details. In other instances, some well-known mechanical principles, structures, and materials of construction, have not been described in detail to avoid unnecessarily obscuring the descriptions of the embodiments of the disclosure.

In the present description, inasmuch as the terms "about," "approximately," or analogous terms, are used, they mean±20% of the indicated range, value, or structure, unless otherwise indicated. It should be understood that the terms "a" and "an" as used herein refer to "one or more" of the enumerated components. The use of the alternative (e.g., "or") should be understood to mean either one, both, or any combination thereof of the alternatives. As used herein, the terms "include" and "comprise" are used synonymously, both of which are intended to be construed in a non-limiting sense, as are variants thereof, unless otherwise expressly stated.

Figure 1:
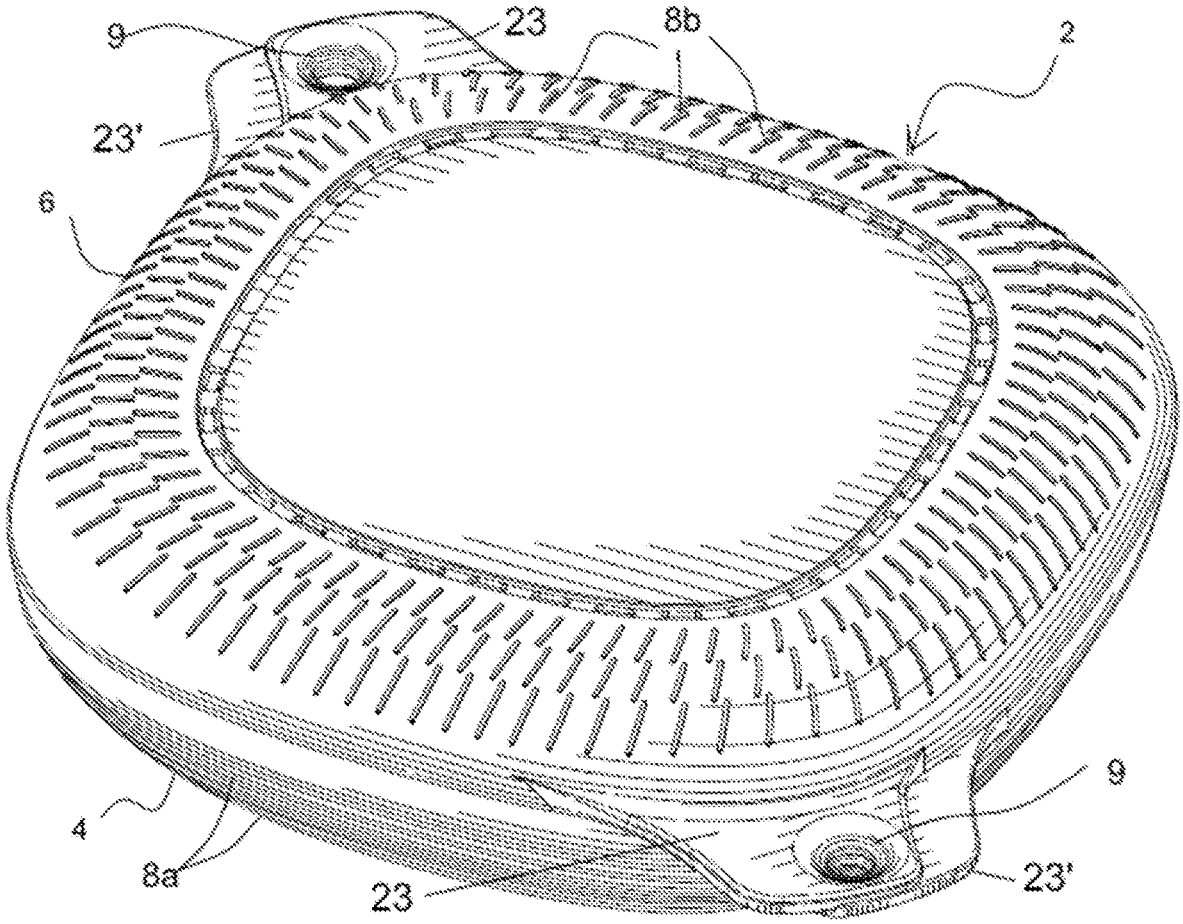
FIG. 1 is a perspective view of a container assembly for some embodiments of the present disclosure.
Figure 1A:
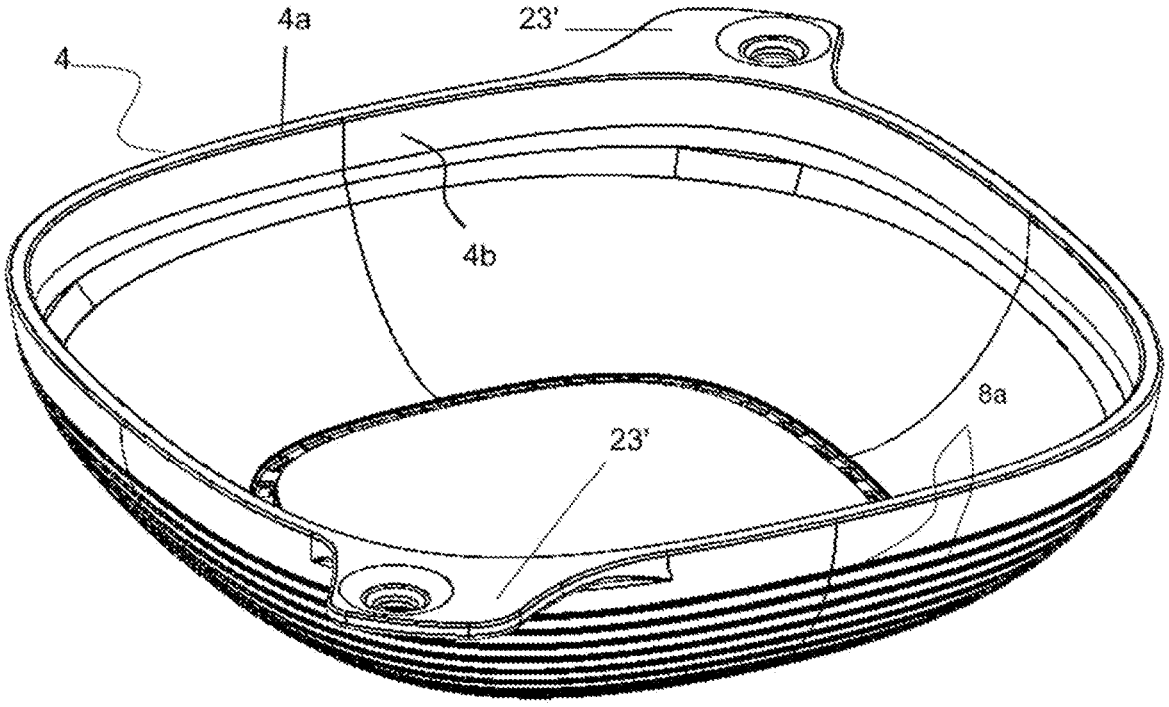
FIG. 1*a* is a perspective view of a bowl, plate or container portion thereof.
Figure 1B:
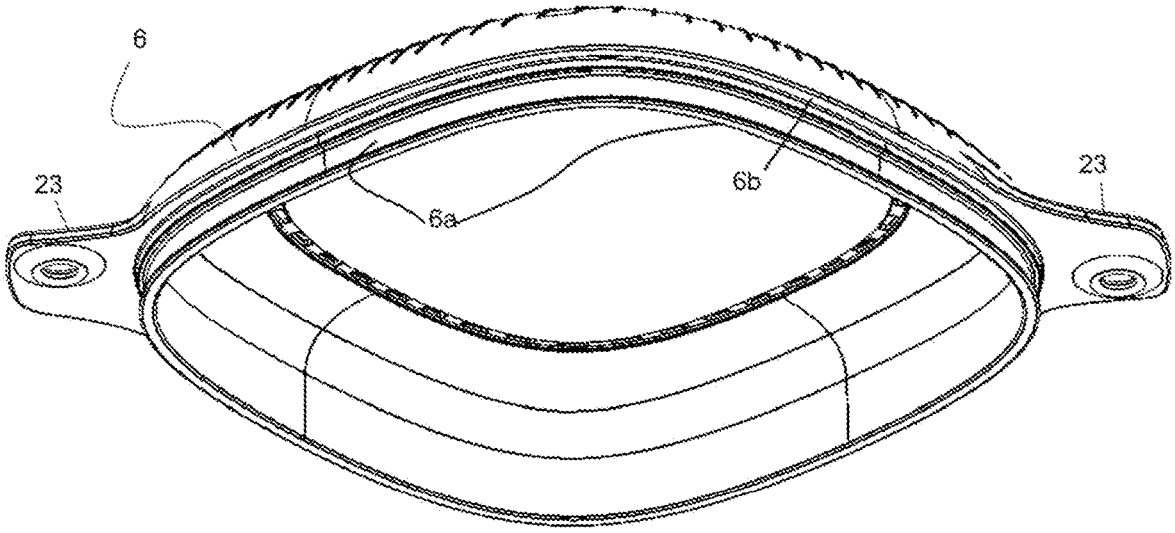
FIG. 1*b* is a perspective view of a lid portion thereof, also usable as a bowl, plate or container.

Referring now to FIGS. 1-1*b*, a container assembly 2 of the present disclosure is shown. The container assembly 2 may comprise a container 4 (e.g., bowl or plate) having a compatible lid 6 component which may also be used as a bowl or plate. The lid component 6 may be releasably attached to the container 4, as shown in FIG. 1, for sealing food contained within the container 4, as a container assembly 2. Also, both the lid component 6 and container 4 may have rubberized grip members 8*a*, 8*b* formed thereon, such as, on the top of lid 6 and on the bottom of bowl 4, to help stabilize either the lid component 6, or container 4, when placed on a surface.

In some embodiments the lid component 6 and/or container 4 are constructed of thermoplastic polymer, such as polypropylene and/or other TPE components. In some embodiments, the materials of construction for the lid 6 and/or container 4 include bamboo, such as, for example, bamboo reinforced thermoplastic polymer composites.

In some embodiments, the lid component 6 of the container assembly 2 includes a downwardly extending flange portion 6*a*, disposed just laterally inward of a perimeter lip portion 6*b*. The flange portion 6*a* extends about the entire lid 6 while being offset just inward of the perimeter lip portion 6*b*. When the lid component 6 is to be releasably connected to the container 4, to seal the container, the flange portion 6*a* of the lid component 6 can be pressed into the container 4, within and against an inward face 4*b* of lip portion 4*a* of the container 4, to releasably couple the lid component 6 to the container 4.

Also, when the lid component 6 is releasably connected to the container 4 to seal the container as described above, handle portions 23 of the lid component 6, which are formed (e.g., integrally formed) on opposite portions thereof, and handle portion 23' of the container 4, which are formed (e.g., integrally formed) on opposite portions thereof, can align such that an aperture 9 formed on each of the handle portions 23 of the lid component 6 aligns with an aperture 9 formed on each of the handle portions 23' of the container 4, but with a section of the handle portions 23, 23' being offset, such that an upward facing surface of each handle portion 23' is exposed past a side edge of each handle portion 23, and conversely, a downward facing surface of each handle portion 23 is exposed past a side edge of each handle portion 23'. The exposed upward and downward facing surfaces can provide convenient access for a user to grip the handle portions 23, 23' separately in order to separate the lid 6 from the container 4.

Referring to FIGS. 2*a*-2*e*, a utensil assembly 40 comprising mating spoon/knife component 10 and spork component 12 (which may be a fork or other utensil other than a spork in some embodiments), is shown. The mating spoon/knife component 10 may comprise a first end portion formed with a knife portion 14, and an opposite end, or second end portion thereof formed with an integral spoon portion 15. The mating spork component 12 may be configured having a first end portion formed as a spork portion 12*c*, and may have an elongated body 12*a* having raised perimeter sidewalls 12*b* formed thereon, with at least one perimeter sidewall 12*b* extending longitudinally on each side of the elongated body 12*a*, to define a longitudinal channel portion 12*d* between the longitudinally extending sidewalls 12*b*.

Also, in some embodiments, the spork component 12 may have a sheath strip 16 disposed at a back end section of the spork component 12, opposite a front end section thereof having a spork portion 12*c*, the sheath strip 16 extending transversely across the elongated body 12*a*, and comprising a sheath strip wall 16' that defines a longitudinally extending interior channel 13.

Figure 2A:
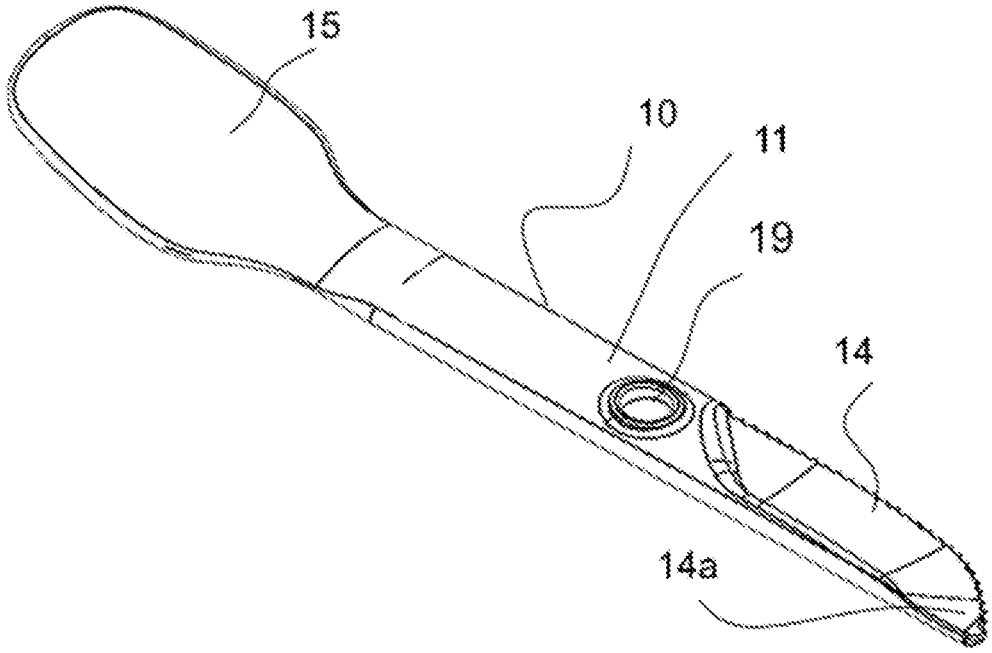
FIG. 2*a* is a perspective view of a spoon/knife component of the utensil assembly of FIG. 2*e*, for some embodiments of the present disclosure.
Figure 2B:
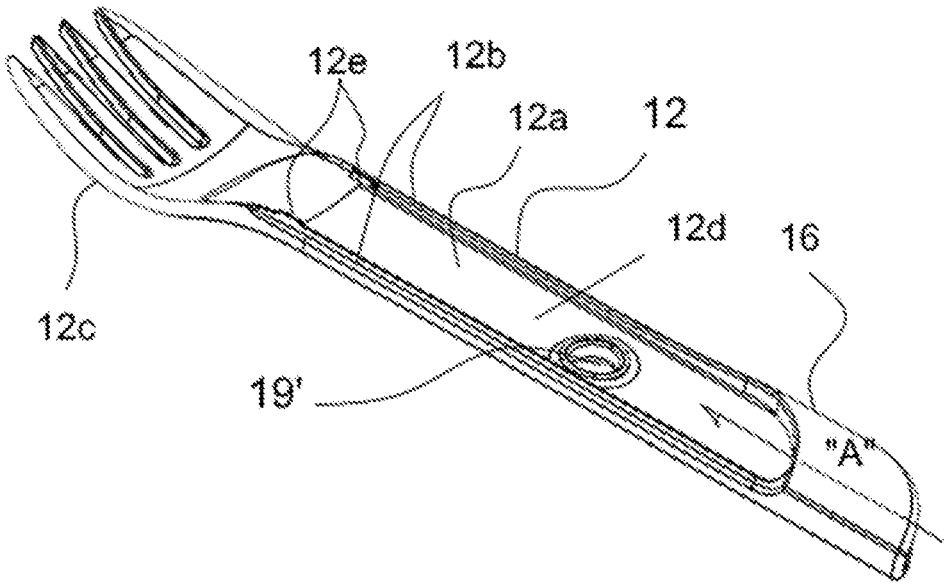
FIG. 2*b* is a perspective view of a spork component of the utensil assembly of FIG. 2*e*, for some embodiments of the present disclosure.
Figure 2C:
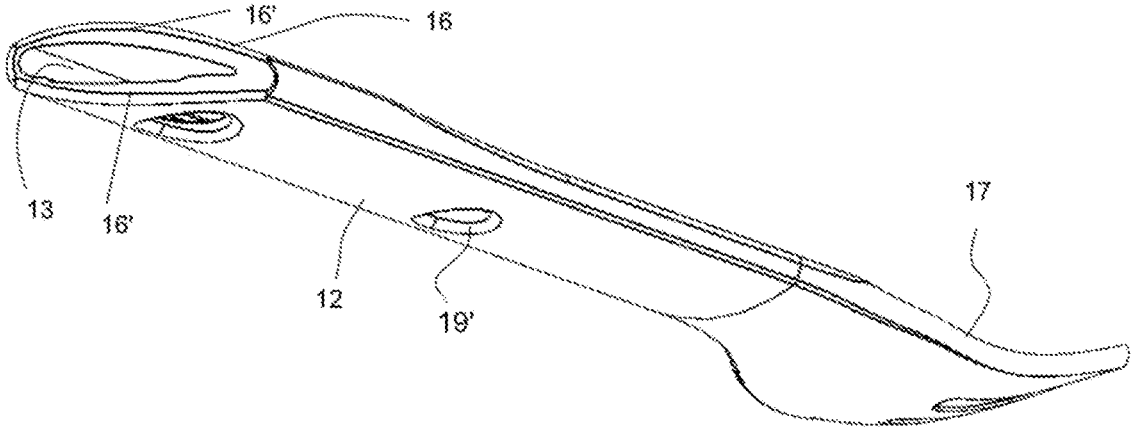
FIG. 2*c* is a bottom back perspective view of the spork component of FIG. 2*b*.
Figure 2D:
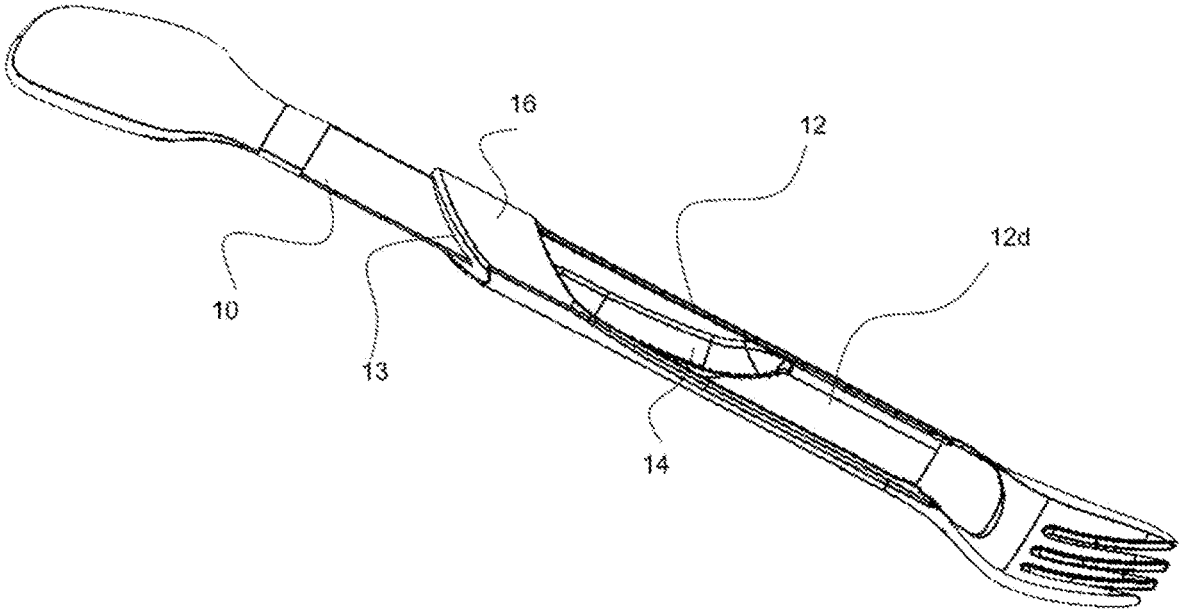
FIG. 2*d* is a perspective view of the spoon/knife component and spork component of FIGS. 2*a* and 2*b*, connected in an extended fashion, for some embodiments of the present disclosure.

Referring to FIG. 2*d*, in some embodiments, an end of the knife portion 14 of the spoon/knife component 10, which defines a back end of the spoon/knife component 10 (opposite the front end portion defined by the spoon portion 15) can be inserted by a user into the interior channel 13 of the spork component 12 through a back facing portion of the sheath ship 16, and the knife portion 14 can be pushed partially through the sheath strip 16 in the general direction of arrow "A," shown in FIG. 2*b*, to releasably attached the spoon/knife component 10 to the spork component 12, in longitudinally aligned fashion, with a spoon end portion 15 extending longitudinally back away from the sheath strip 16, such that the spoon/knife component 10 and spork component 12 are attached in an extended fashion.

Figure 2E:
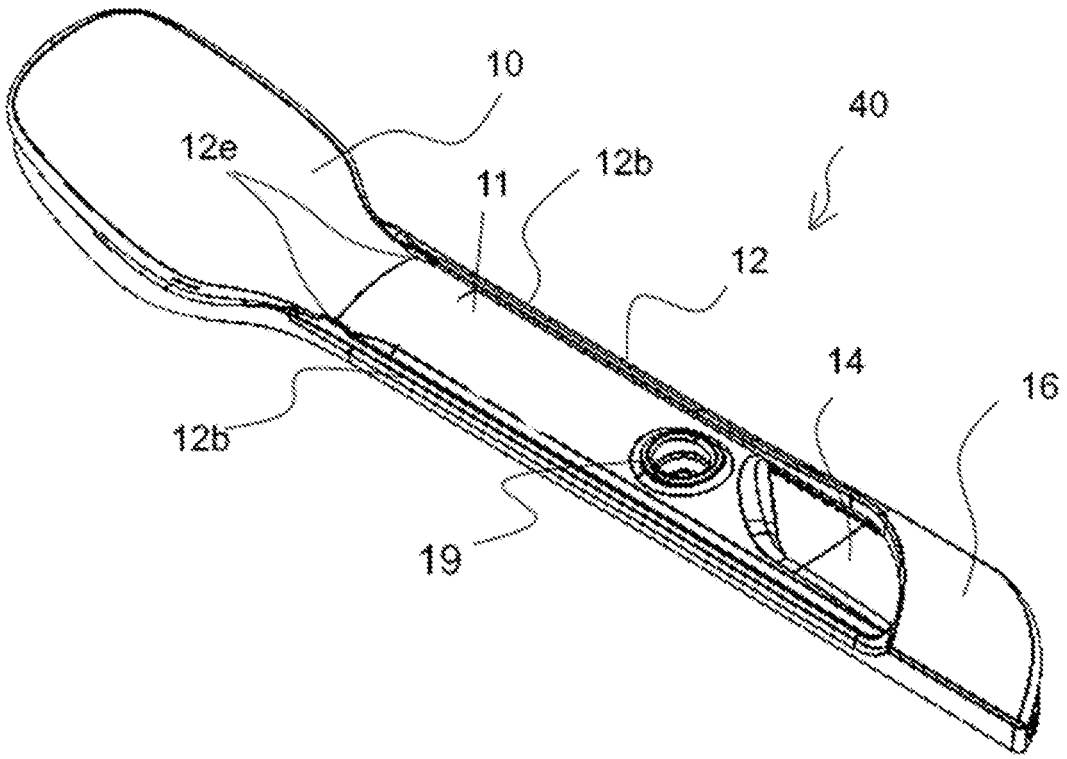
FIG. 2*e* is a perspective view of a utensil assembly for some embodiments of the present disclosure, comprising the spoon/knife component of FIG. 2*a*, and spork component of FIG. 2*b*, being connected together in nested fashion.

Referring to FIG. 2*e*, alternatively, the spoon/knife component 10 can be releasably attached to the spork component 12 in a nested fashion, with a body portion 11 of the spoon/knife component 10 being snap fit between the perimeter sidewalls 12*b* of the spork component 12, to releasably attached the spoon/knife component 10 to the spork component 12, and with a convex bottom surface of the spoon portion 15 nested within a concave top surface of the spork portion 12*c*, and further with an end portion of the knife portion 14 having been inserted into the interior channel 13 at a front facing portion of the sheath strip 16, in a direction opposite to that of arrow "A," that is, in particular, with the knife portion 14 having been inserted into the interior channel 13 by having been slide in a backward direction into the channel 13, rather than a forward direction as designated by arrow "A," in FIG. 2*b*.

Moreover, in some embodiments, as shown in FIG. 2*e*, when the spoon/knife component 10 is releasably attached to the spork component 12 in a nested fashion, the body portion 11 of the spoon/knife component 10 is snap fit between the perimeter sidewalls 12*b* of the spork component 12, by being manually pressed downwardly against inwardly extending tabs 12*e* of the sidewalls 12*b*, until the body portion 11 snaps past the tabs 12*e* to a position below the tabs 12*e* (as best seen in FIG. 2*e*) thereby being releasably secured by the tabs 12*e* against a surface of spork component 12.

Figure 4:
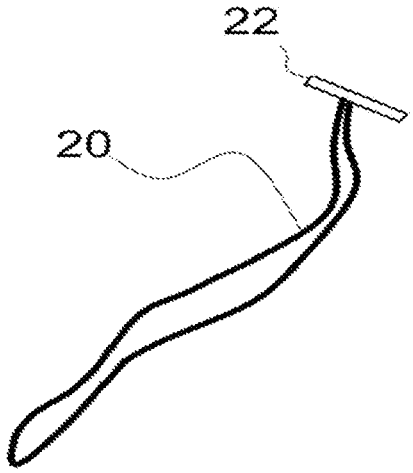
FIG. 4 is a simplified illustration of a flexible resilient tether device as provided for some embodiments of the present disclosure.

In some embodiments, the utensil assembly 40 of FIG. 2*e* includes a flexible resilient tether 20 (see, e.g., FIG. 4), having a stop member 22, which can be threaded through apertures, such as apertures 19, 19' on the spoon/knife component 10 and spork component 12 respectively. That is, for example, without limitation, when the apertures 19, 19' are aligned with the components 10, 12 being snap fit together in nested fashion (as discussed above), the tether 20 can be threaded through the apertures 19, 19' and pulled through until the stop member 22 abuts against a perimeter of one of the apertures, and a closed loop of the tether can be manipulated to attach the tether 20 in any of a variety of manners, the utensil assembly 40 to an object, as will be appreciated by those skilled in the art upon reviewing this disclosure.

Figure 3A:
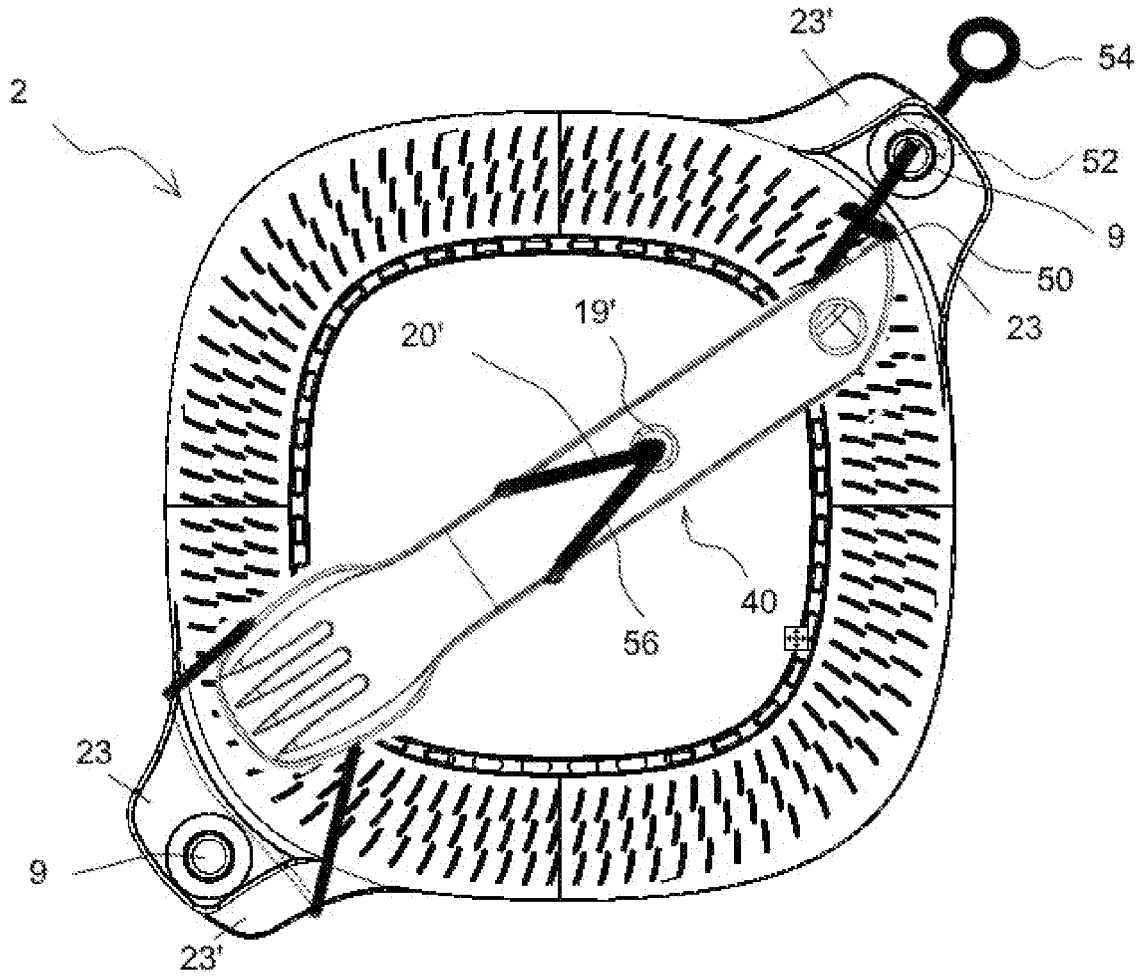
FIG. 3*a* is an overhead plan view of the container assembly of FIG. 1, further showing the utensil assembly of FIG. 2*e* releasably connected thereto by a flexible resilient tether device, for some embodiments of the present disclosure.

Or alternatively, and for example, without limitation, as shown in FIG. 3*a*, the stop member 22 of the tether 20 may be utilized to stop the tether 20 from pulling through an aperture 9 on the container assembly 2, with the tether 20 threaded through aligned apertures 9 on the container assembly, and further through apertures 19, 19' on the utensil assembly 40, and with a closed loop of the tether 20 being looped about handle portions 23, 23' of the sealed container assembly 2 to anchor the tether 20 to those handle portions 23, 23'.

Figure 3B:
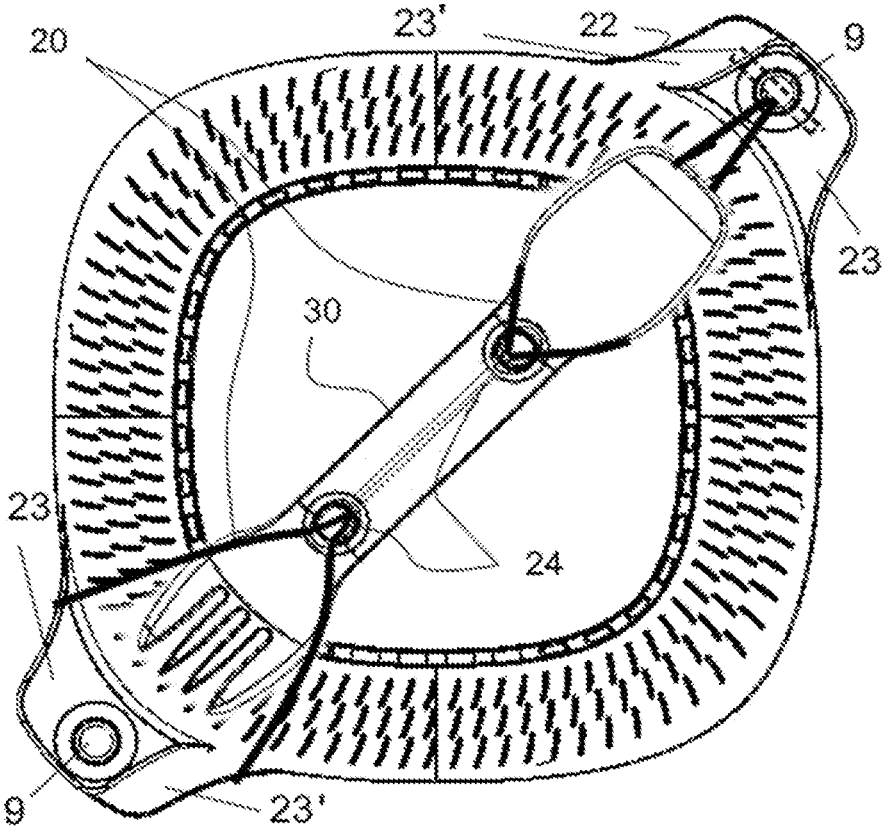
FIG. 3*b* is an overhead plan view of the container assembly of FIG. 1, further showing the spork utensil FIG. 5 releasably connected thereto by a flexible resilient tether device, for some embodiments of the present disclosure.
Figure 5:
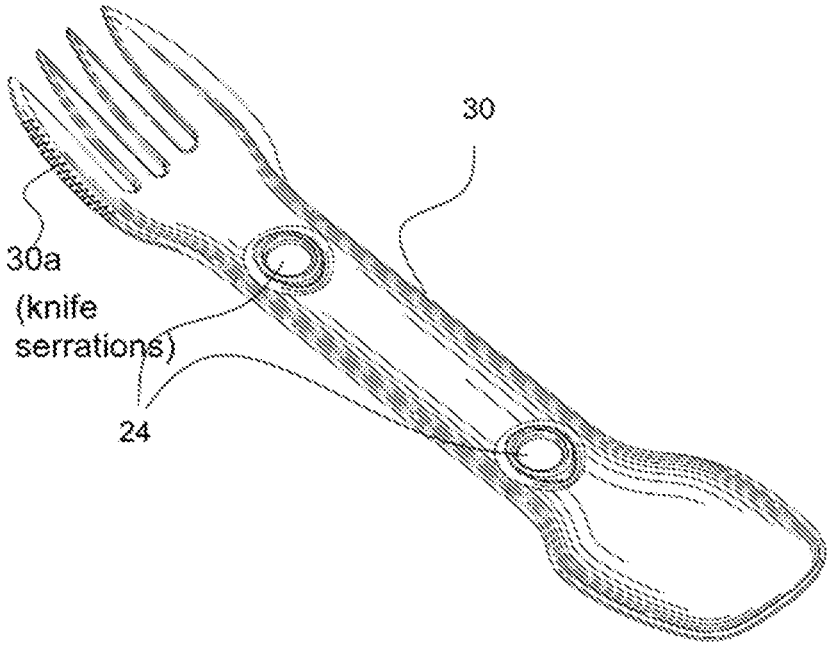
FIG. 5 is a top perspective view showing an embodiment of a spork utensil of the present disclosure.

FIG. 5 illustrates another example spork utensil 30 of the present disclosure, and FIG. 3*b* illustrates an example structure and way by which the spork utensil 30 can be coupled to the container assembly 2 to form a mess kit, using tether 20 and apertures 24 integral to the spork utensil 30. In particular, the spork utensil 30 can be attached to the container assembly 2 such as by, for example, threading the tether 20 through aligned apertures 9 on a first pair of aligned handle portion 23, 23' of the container assembly 2, then through at least a first aperture 24 on the spork utensil 30, then back through at least a second aperture 24 in the spork utensil 30, and then an end of a closed loop portion of the tether 20 may be looped around handle portions 23, 23', to anchor the tether 20. That is, for example, the tether 20 can be constructed in a closed looped, with an end of the tether being attached to stop member 22.

In some embodiments, a concave shape of the spoon and spork portions of the utensil 30 are formed with a surface curvature to provide for easy nesting storage of multiple utensils 30, if and when a user desires to store such utensils 30 together.

Figure 6:
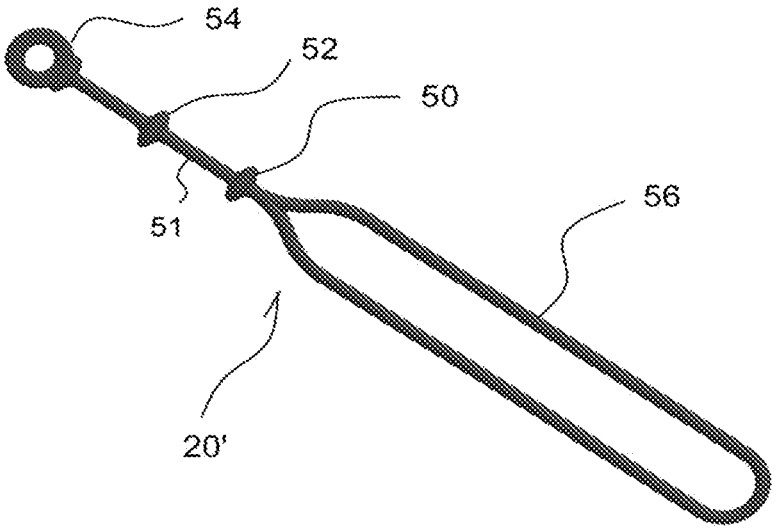
FIG. 6 is a perspective view of a flexible resilient tether device as provided for some embodiments of the present disclosure, different from the tether device shown in FIG. 4.

FIG. 6 shows an alternative embodiment of a flexible resilient tether 20' of the present disclosure. The tether 20' can include a neck portion 51 having multiple stop members formed at space apart locations thereon, including a first stop knob 50, a second stop knob 52 and a stop ring 54 attached to an end portion of the neck portion 51, as well as a closed loop body portion 56. Each of the stop knobs 50, 52, can define a portion of the tether 20' having a greater circumference than the neck portion 51, or a greater maximum lateral width than the neck portion, or any portion of the neck portion 51. In addition, a maximum lateral width of the stop ring 54 is also greater than any diameter or any width of the neck portion 1. In some embodiments, the tether 20' is elastic and resilient, can be stretched lengthwise resiliently to selectively position the stop knobs 50, 52, relative to apertures 9 on the container assembly.

Figure 7A:
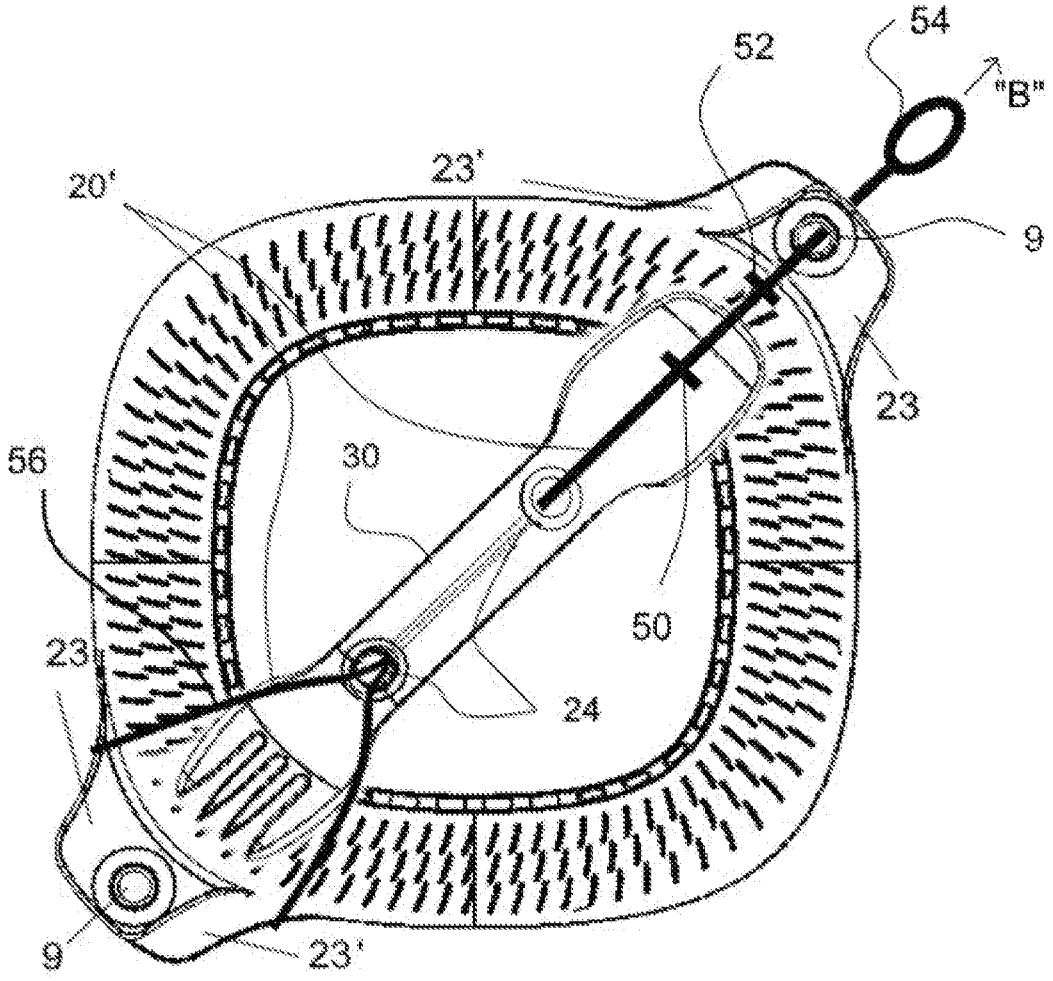
FIG. 7*a* is a top plan view of the container assembly of FIG. 1, further showing the spork utensil of FIG. 5 releasably attached thereto by the flexible resilient tether device of FIG. 6.
Figure 7B:
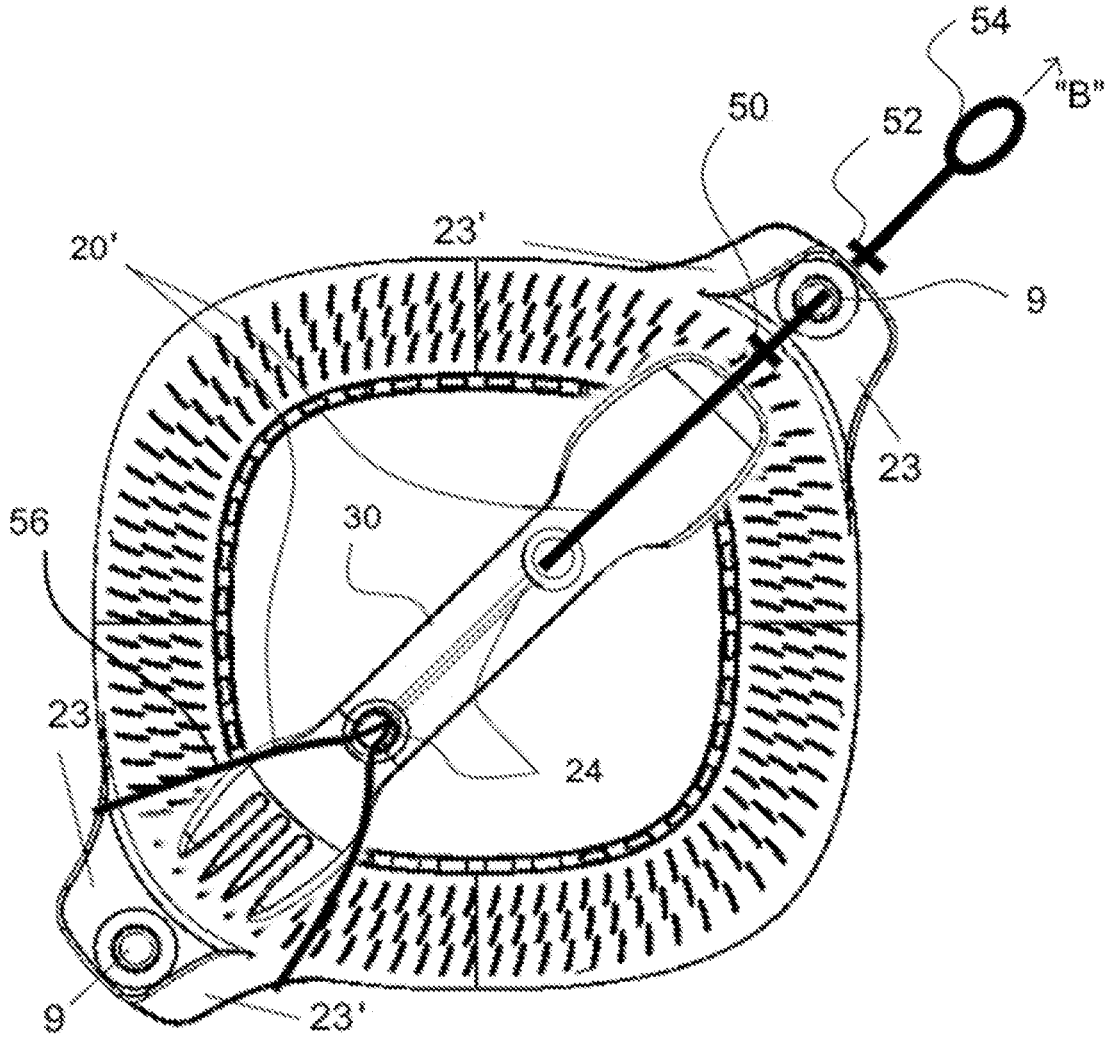
FIG. 7*b* is a top plan view of the container assembly of FIG. 7*a*, further showing the flexible resilient tether device having been pulled further in the direction of arrow "B," to tighten the tether device against the spork utensil.

For example, as shown in FIGS. 7*a* and 7*b*, the tether 20' is attached to a utensil 30, with a neck portion 51 thereof threaded through aligned apertures 9 on handle portions 23, 23' of the container assembly 2, with the stop ring 54 serving as an end stop member against the tether 20' being pulled through the apertures 9 on one end thereof, and with another end of the tether 20' being anchored about opposite handle portions 23, 23' of the container assembly 2 by the closed loop body portion 56. As can be seen by viewing FIGS. 7*a* and 7*b* in order, in FIG. 7*a*, the stop ring 54 is disposed on one side of aligned apertures 9 (i.e., first aligned apertures) on the right side handle portions 23, 23', while both stop knobs 50, 52 of the neck portion 51 are disposed on an opposite side of the first aligned apertures 9, then in FIG. 7*b*, outer stop knob 52 has been pulled through the first aligned apertures 9 to the same side as the stop ring 54, by a user having pulled on stop ring 54 in the direction of arrow "B" in FIGS. 7*a* and 7*b*.

In some embodiments, the stop knobs 50, 52 provide resistance against being pulled through the apertures 9 based only a resilient tendency of the tether 20' to contract when stretched within certain normal use ranges (e.g., by have larger maximum diameter or width than a width of the apertures 9), while a user is able to apply sufficient force to compress the stop knobs 50, 52 and pull them through the apertures by pulling on the stop ring 54. Therefore, a user is able to tighten the tether 20' by pulling the stop ring 52 in the direction of arrow "B," as described above, to pull the stop knob 52 to an opposite side of first aligned apertures 9 relative to stop knob 50, such that tension is increased on the tether 20', with the closed loop body portion 56 having remained anchored to the opposite handle portions 23, 23'.

Figure 8:
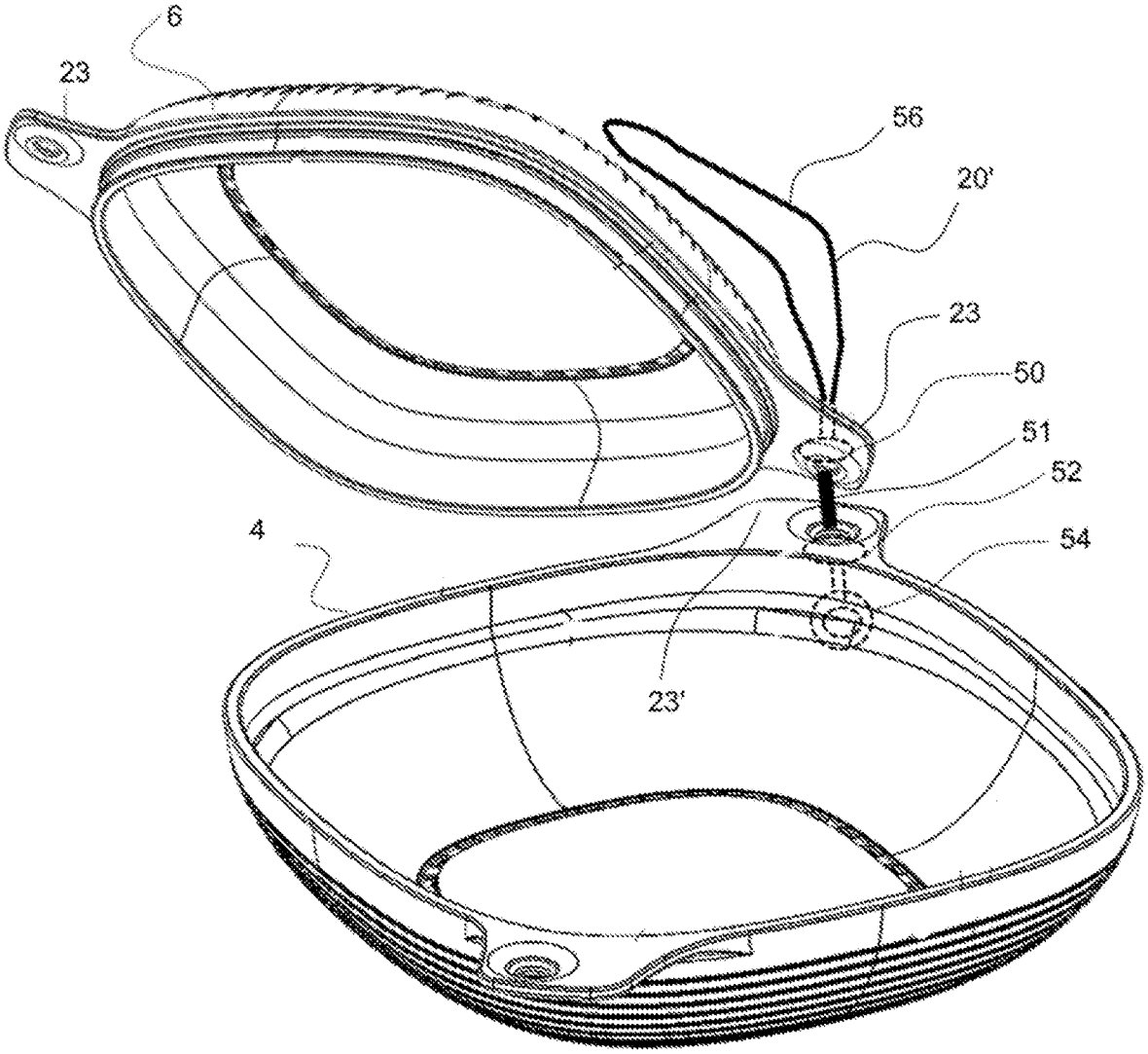
FIG. 8 is a perspective view of the lid and container of FIGS. 1*a* and 1*b*, connected together using the tether device of FIG. 6.

Referring to FIG. 8, moreover, when any of the stop knobs 52, 50 and/or stop ring 54 are on opposite sides of the first aligned apertures 9 on handle portions 23, 23', those handle portions 23, 23' can be held together by the neck portion 51 while user can remove the closed loop body portion 56 from the opposite side handle portions 23, 23' (left side in FIG. 8), in order to separate those oppose side handle portions and access the content of the container assembly 2, while one side of the handle portions 23, 23' is hinged together, as will be appreciated by those skilled in the art after reviewing this disclosure.

After reviewing the present disclosure, an individual of ordinary skill in the art will immediately appreciate that some details and features can be added, removed and/or changed without deviating from the spirit of the invention. Reference throughout this specification to "one embodiment," "an embodiment," "additional embodiment(s)" or "some embodiments," means that a particular feature, structure or characteristic described in connection with the embodiment(s) is included in at least one or some embodiment(s), but not necessarily all embodiments, such that the references do not necessarily refer to the same embodiment(s). Furthermore, the particular features, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A mess kit, comprising:

a container, including:

a bowl; and a first handle and a second handle coupled to the bowl on opposite sides of the bowl; and a lid releasably coupleable to the container, the lid including:

a first handle portion and a second handle portion on opposite sides of the lid, the first handle portion and the second handle portion structured to interface with the first handle and the second handle of the container and assist, at least in part, in securing the lid to the container;

an aperture in at least one of the first handle portion and the second handle portion; and a flange structured to interface with the container to provide a seal between the container and the lid in response to the lid being coupled to the container, wherein the lid can be manipulated relative to the container between a locked configuration in which the lid is coupled to the container and an unlocked configuration in which the lid is uncoupled from the receptacle, wherein in the locked configuration, at least a portion of one of the first handle portion and the second handle portion on the lid is offset from a corresponding one of the first handle and the second handle on the container, and the aperture extends through the at least one of the first handle portion and the second handle portion, and wherein the aperture is sized and shaped to receive a fastener that, when inserted through the aperture in the locked configuration, prevents the lid from being manipulated from the locked configuration to the unlocked configuration.

2. The mess kit of claim 1, wherein the flange of the lid extends around an entirety of the lid and is offset from a perimeter lip portion of the lid.

3. The mess kit of claim 1, wherein the container includes a lip structured to interface with the flange of the lid to provide the seal.

4. The mess kit of claim 3, wherein the flange of the lid is in contact with an inward face of the lip of the container in response to the lid being coupled to the container.

5. The mess kit of claim 1, wherein the first handle and the second handle of the container are offset from the first handle portion and the second handle portion of the lid.

6. The mess kit of claim 1, wherein the aperture is a first aperture being in both the first handle portion and the second handle portion of the lid, and the first handle and the second handle of the container each include a second aperture structured to interface with the first apertures.

7. The mess kit of claim 6, wherein the first apertures and the second apertures are configured to interface with each other and assist, at least in part, in securing the lid to the container.

8. A mess kit, comprising:

a container, including:

a bowl;

a first handle and a second handle coupled to the bowl with the first handle and the second handle arranged on opposite sides of the bowl;

a lip portion extending from the bowl, the lip portion having an inward face; and a lid releasably coupleable to the container, the lid including:

a first handle portion and a second handle portion positioned on opposite sides of the lid;

an aperture in at least one of the first handle portion and the second handle portion; and a flange structured to interface with the inward face of the lip portion of the bowl of the container to provide a seal between the container and the lid in response to the lid being coupled to the container, wherein the lid can be manipulated relative to the container between a locked configuration in which the lid is coupled to the container and an unlocked configuration in which the lid is uncoupled from the receptacle, wherein in the locked configuration, at least a portion of one of the first handle portion and the second handle portion on the lid is offset from a corresponding one of the first handle and the second handle on the container, and the aperture extends through the at least one of the first handle portion and the second handle portion, and wherein the aperture is sized and shaped to receive a fastener that, when inserted through the aperture in the locked configuration, prevents the lid from being manipulated from the locked configuration to the unlocked configuration.

9. The mess kit of claim 8, wherein the container further includes at least one grip member on a bottom portion of the bowl.

10. The mess kit of claim 9, wherein the at least one grip member includes a plurality of rubberized grip members on the bottom portion of the bowl.

11. The mess kit of claim 8, wherein the lip portion of the container extends around an entirety of the bowl.

12. The mess kit of claim 8, wherein the first handle of the container interfaces with the first handle portion of the lid and the second handle of the container interfaces with the second handle portion of the container in response to the lid being coupled to the container, the first handle offset from the first handle portion and the second handle offset from the second handle portion.

13. The mess kit of claim 8, wherein the lid includes a perimeter lip portion, the flange of the lid positioned laterally inward from the perimeter lip portion of the lid.

14. The mess kit of claim 8, wherein the aperture is in both the first handle portion and the second handle portion of the lid.

15. A mess kit, comprising:

a container, including:

a bowl; and a first handle and a second handle arranged on opposite sides of the bowl; and a lid releasably coupleable to the container, the lid including:

a first handle portion and a second handle portion positioned on opposite sides of the lid; and an aperture in least one of the first handle portion and the second handle portion, the first handle portion and the second handle portion of the lid structured to interface with the first handle and the second handle of the container to assist, at least in part, in securing the lid to the container, wherein the lid can be manipulated relative to the container between a locked configuration in which the lid is coupled to the container and an unlocked configuration in which the lid is uncoupled from the receptacle, wherein in the locked configuration, at least a portion of one of the first handle portion and the second handle portion on the lid is offset from a corresponding one of the first handle and the second handle on the container, and the aperture extends through the at least one of the first handle portion and the second handle portion, and wherein the aperture is sized and shaped to receive a fastener that, when inserted through the aperture in the locked configuration, prevents the lid from being manipulated from the locked configuration to the unlocked configuration.

16. The mess kit of claim 15, wherein the lid includes a flange structured to interface with the container to provide a seal between the container and the lid in response to the lid being coupled to the container.

17. The mess kit of claim 16, wherein the container includes a lip portion with an inward face, and the flange interfaces with the inward face of the lip portion of the container in response to the lid being coupled to the container.

18. The mess kit of claim 15, wherein the first handle and the second handle of the container each include a further aperture, the apertures of the first handle portion and the second handle portion of the lid and the further apertures of the first handle and second handle of the container structured to assist, at least in part, with securing the lid to the container.

19. The mess kit of claim 15, wherein the at least one grip member on the bowl is a plurality of rubber grip members on a bottom portion of the bowl.

20. The mess kit of claim 15, wherein the lid includes a further plurality of grip members on the lid.

* * * * *